US006148463A

United States Patent [19]

Shimizu et al.

[11] Patent Number: 6,148,463

[45] Date of Patent: Nov. 21, 2000

[54] CLEANING APPARATUS

[75] Inventors: Noburu Shimizu; Koji Ato, both of Kanagawa-ken, Japan

[73] Assignee: Ebara Corporation, Tokyo, Japan

[21] Appl. No.: 09/080,453

[22] Filed: May 19, 1998

[30] Foreign Application Priority Data

May 19, 1997 [JP] Japan ..... 9-144757

[51] Int. Cl.[7] ..... B08B 11/02; A46B 13/04

[52] U.S. Cl. ..... 15/102; 15/88.2; 15/21.1; 15/77

[58] Field of Search ..... 15/102, 88.2, 77, 15/88.3, 21.1, 88.1, 302, 97.1, 28, 87; 134/902

[56] References Cited

U.S. PATENT DOCUMENTS

| | | | |
|---|---|---|---|
| 1,641,103 | 8/1927 | Small . | |
| 1,653,108 | 12/1927 | Koenig . | |
| 2,290,533 | 7/1942 | Campbell . | |
| 5,685,039 | 11/1997 | Hamada et al. | 15/88.2 |
| 5,829,087 | 11/1998 | Nishimura et al. | 15/102 |
| 5,860,178 | 1/1999 | Nishimura et al. | 15/102 |
| 5,860,181 | 1/1999 | Maekawa et al. | 15/102 |
| 5,901,403 | 5/1999 | Yang | 15/102 |
| 5,956,791 | 9/1999 | Bassi et al. . | |

FOREIGN PATENT DOCUMENTS

| | | |
|---|---|---|
| 6-84858 | 3/1994 | Japan . |
| 8-71511 | 3/1996 | Japan . |
| 9-92633 | 4/1997 | Japan . |

*Primary Examiner*—Gary K. Graham
*Attorney, Agent, or Firm*—Wenderoth, Link & Ponack, L.L.P.

[57] ABSTRACT

The cleaning apparatus of the present invention comprises a cleaning member 105 adapted to be rotated while maintaining contact with a surface of a semiconductor wafer W, to thereby clean the surface of the semiconductor wafer W, and a drive motor 50 for rotating the cleaning member 105. A linear bushing 75 and coil springs 81 are provided between the cleaning member 105 and the drive motor 50. The linear bushing 75 ensures that the cleaning member 105 is capable of slidably moving in a direction of an axis of rotation. The coil springs 81 ensure that the cleaning member 105 applies a predetermined pressure to the semiconductor wafer W. A pressure in a casing 1 [(1-1), (1-2) and (1-3)] is set to a negative pressure relative to an outside air pressure by suction through a pipe 111.

9 Claims, 7 Drawing Sheets

CLEANING APPARATUS

BACKGROUND OF THE INVENTION

The present invention relates to a cleaning apparatus having a cleaning member which is adapted to be brought into contact with a surface of a workpiece to be cleaned, such as a semiconductor wafer, and effect cleaning of the surface of the workpiece.

A workpiece such as a semiconductor wafer which has been subjected to polishing or chemical treatment in a polishing apparatus has a contaminated surface. In order to clean the surface of the workpiece, a scrubbing apparatus has been conventionally used.

The phase scrubbing apparatus herein means a cleaning apparatus in which a cleaning member, such as a sponge, is rotated and pressed against a workpiece to be cleaned, which is also rotated, to thereby scrub the surface of the workpiece. As the cleaning member, a column type cleaning member or a pencil type cleaning member is used.

In a conventional scrubbing apparatus, in order to ensure that the cleaning member applies a predetermined pressure to the workpiece to be cleaned, a member attached to the cleaning member, such as an arm, is controlled to be positioned at a predetermined distance from the workpiece when the cleaning member is pressed against the workpiece.

However, when the pressure applied to the workpiece by the cleaning member, such as a sponge, is controlled in such a manner as mentioned above, it is difficult to maintain the pressure exerted by the sponge at a predetermined level. That is, a problem occurs, such that when the cleaning member, such as a sponge, undergoes permanent deformation or wear as a result of prolonged use, the pressure exerted by the sponge changes from that exerted in an early period.

As a countermeasure for the above-mentioned problem, it has been considered to employ a method in which the pressure exerted by the cleaning member is controlled by connecting a load measuring device to the member attached to the cleaning member and monitoring an output of the load measuring device so as to maintain the output of the load measuring device at a predetermined level.

However, the above-mentioned method requires a complicated structure. In addition, it is difficult to adjust the pressure exerted by the cleaning member following a slight change in load applied to the workpiece.

On the other hand, there is a mechanism in which the pressure exerted by the cleaning member is controlled by providing a spring, an air cylinder or a balancing weight between the cleaning member and a drive motor for rotating the cleaning member, or between the cleaning member and drive motor as a whole and a vertical drive mechanism for vertically moving the cleaning member and drive motor.

However, the above-mentioned mechanism simply utilizing a spring, an air cylinder or a balancing weight results in the occurrence of an undesirable shift of movable members associated with the cleaning member with a consequent high friction between the movable members and stationary members. Therefore, this mechanism is unsuitable for maintaining a load applied to a workpiece at a predetermined level by smooth adjustment following a slight change in the load.

SUMMARY OF THE INVENTION

In view of the above, the present invention has been made. It is an object of the present invention to provide a cleaning apparatus which is capable of maintaining a load applied to a workpiece by a cleaning member, such as a sponge, at a predetermined level even when permanent deformation or wear of the cleaning member occurs as a result of prolonged use, and which is capable of adjusting the cleaning member immediately and smoothly following a slight change in load applied to the workpiece.

In order to solve the above-mentioned problem accompanying the conventional cleaning apparatus, in the cleaning apparatus of the present invention having a cleaning member adapted to be brought into contact with a surface of a workpiece to be cleaned and effect cleaning of the surface of the workpiece, a translation guide mechanism, such as a linear bushing, is provided to support the cleaning member, such that the cleaning member is capable of slidably moving in a direction away from the surface of the workpiece.

Further, in the cleaning apparatus of the present invention, pressure adjusting means (or pressure applying member), such as a resilient means or a weight, may be provided to adjust the cleaning member to apply a predetermined pressure to the workpiece.

BRIEF DESCRIPTION OF THE DRAWINGS

FIG. 3(*b*) is a bottom plan view of the housing bushing in the cleaning member supporting part of FIG. 2.

DETAILED DESCRIPTION OF THE INVENTION

Figure 1:
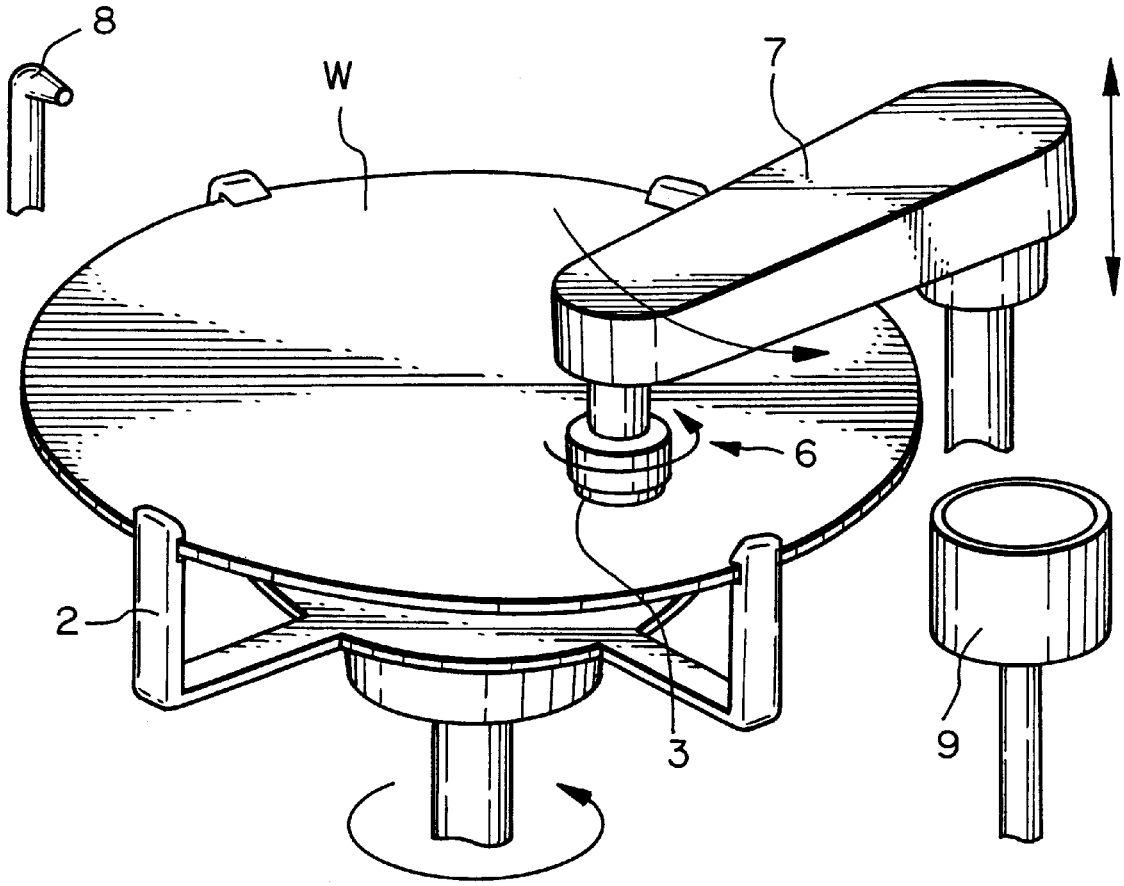
FIG. 1 is a perspective view of an entire cleaning apparatus of the present invention.

FIG. 1 is a perspective view of a cleaning apparatus of the present invention.

This apparatus comprises: a spinning chuck 2 adapted to hold a semiconductor wafer W and rotate horizontally at a predetermined rotation speed; a cleaning member supporting part 6 for holding and rotating a pencil type cleaning member 3 made of porous material; a cleaning liquid nozzle 8 for ejecting a cleaning liquid onto a surface to be cleaned of the semiconductor wafer; and a cleaning cup 9 for cleaning the cleaning member. The cleaning member supporting part 6 is provided with a vertically movable swing arm 7 and an internal motor so that the cleaning member can be driven to rotate at a predetermined rotation speed while maintaining contact with the surface of the semiconductor wafer. The arm is capable of pivoting in a horizontal direction about a vertical axis passing through a base end portion thereof.

The semiconductor wafer is subjected to rinsing or scrubbing using a brush, to thereby remove relatively large particles. The resultant semiconductor wafer is, then, conveyed to the cleaning apparatus of the present invention. The semiconductor wafer is held by the spinning chuck 2, such that the surface to be cleaned is exposed upward. While rotating the semiconductor wafer held by the spinning chuck 2 at a predetermined rotation speed, the cleaning liquid is ejected from the cleaning liquid nozzle 8 toward the center of the semiconductor wafer.

The cleaning member supporting part 6 rotates the cleaning member in contact with the exposed surface of the semiconductor wafer, and at the same time pivots the arm so that the cleaning member is moved from the center to an outer circumferential edge of the semiconductor wafer at a predetermined rate, to thereby scrub the semiconductor wafer. The arm 7 which has been pivoted to the outer circumferential edge of the wafer is stopped and lifted away from the exposed surface of the semiconductor wafer, thus completing one operating cycle. This operating cycle can be repeated by pivoting the arm 7, which has been lifted at the outer circumferential edge of the wafer, to the center of the wafer.

After the above-mentioned operating cycle has been conducted at least once, the ejection of the cleaning liquid from the cleaning liquid nozzle 8 is stopped and the arm is pivoted so as to move the cleaning member to the position above the cleaning cup 9. Thereafter, the cleaning member is lowered and rotated in the cleaning cup, to thereby effect self-cleaning of the cleaning member. Thus, a cleaning operation is completed.

Immediately after completion of the cleaning operation, the spinning chuck 2 is rotated at a high speed in an atmosphere of a dried inert gas, to thereby spin-dry the semiconductor wafer.

The reason why the arm 7 is moved from the center to the outer circumferential edge of the semiconductor wafer for cleaning is as follows. When the semiconductor wafer is rotated by the spinning chuck 2, contaminants and particles on an upper surface of the wafer receive a centrifugal force due to rotation. Therefore, by moving the arm 7 from the center to the outer circumferential edge of the semiconductor wafer, the contaminants and particles on the upper surface of the wafer are discarded in the same direction as that of the centrifugal force.

Figure 2:
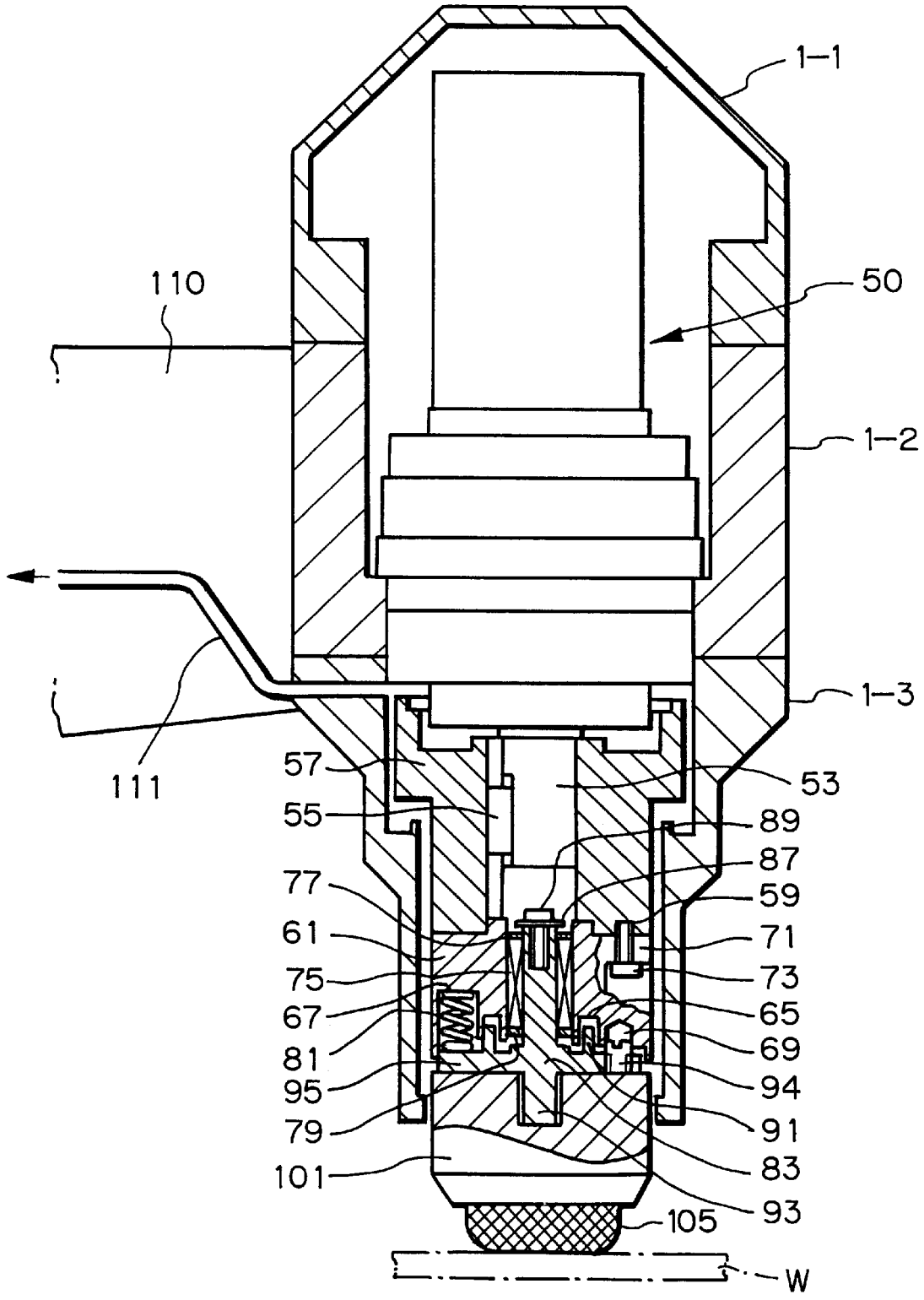
FIG. 2 is a partial longitudinal sectional view of a cleaning member supporting part according to a first embodiment of the present invention, which is used in the cleaning apparatus of FIG. 1.

FIG. 2 shows a cross-sectional view of the cleaning member supporting part 6 in the cleaning apparatus shown in FIG. 1. As shown in FIG. 2, the cleaning member supporting part 6 has a drive motor 50 for rotating the cleaning member 3 in a casing 1 [(1-1), (1-2) and (1-3)].

The drive motor 50 is connected to a motor shaft 53, which is connected to a member 57 with a key 55 being provided therebetween. The member 57 is fixed to a bushing housing 61 which is provided below the member 57, by means of screws 73. As the drive motor 50, a dust-free motor is preferably used.

Figure 3A:
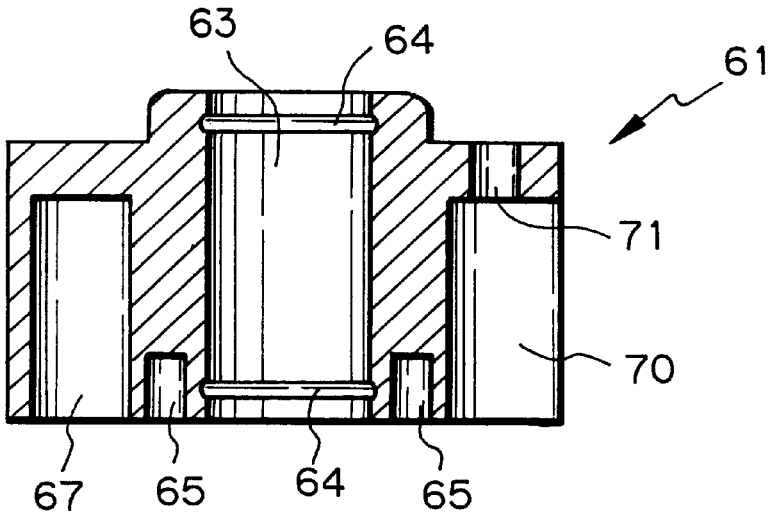
FIG. 3(*a*) is a side elevation view of a housing bushing in the cleaning member supporting part of FIG. 2.
Figure 3B:
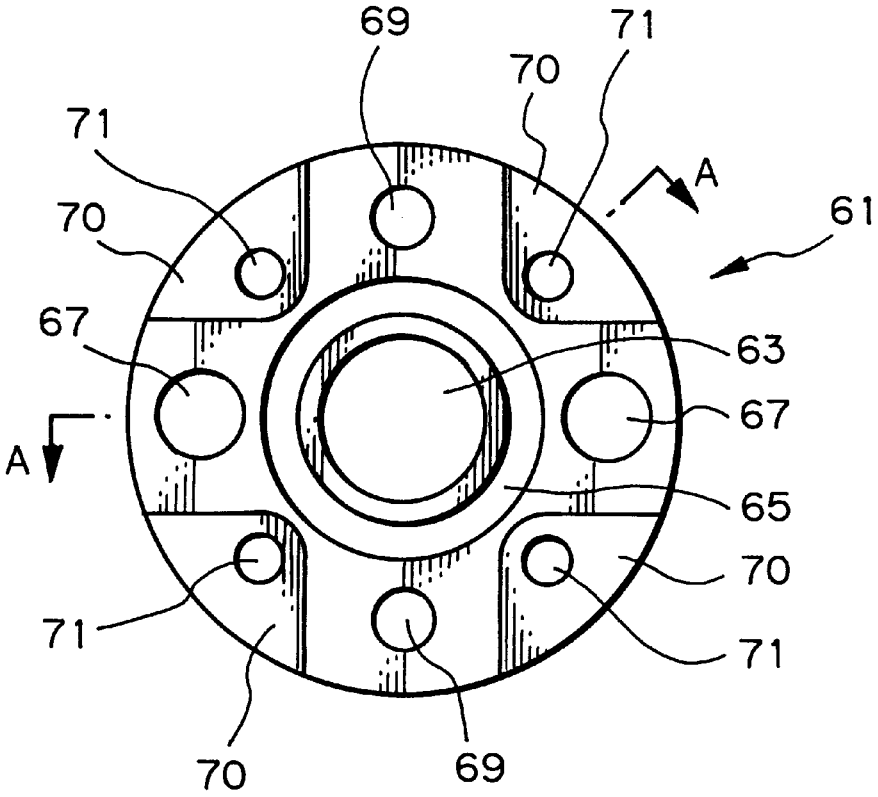

FIGS. 3(*a*) and 3(*b*) show bushing the housing 61. FIG. 3(*a*) is a side cross-sectional view of the bushing housing 61 [a cross-sectional view of FIG. 3(*b*), taken along the line A—A] and FIG. 3(*b*) is a back view of the housing bush 61.

As shown in FIGS. 3(*a*) and 3(*b*) the bushing housing 61 has a through-hole 63 at the center thereof. A ring or annular groove 65 is formed around the through-hole 63 in a lower surface of the bushing housing 61. Further, in the bushing housing 61, two spring insertion holes 67, two engaging holes 69 and four recesses 70 are formed around the ring groove 65. Each of the recesses 70 has formed therein a fixing hole 71. Circumferential grooves 64 for fixedly fitting therein below-mentioned fixing members 77 and 79 are provided in upper and lower parts of the through-hole 63.

The bushing housing 61 shown in FIG. 2 is fixed to the member 57 by threadedly engaging the screws 73 inserted through the four fixing holes 71 with threaded bores 59 provided in the member 57. That is, the motor shaft 53, the member 57 and the bushing housing 61 are rotated as a unit.

Further, in the bushing housing 61, a linear bushing 75 is fixed in the through-hole 63 by means of the fixing members 77 and 79. The linear bushing 75 serves as translation guide means for supporting a shaft of a shaft pin 83.

On the other hand, the shaft pin 83 shown in FIG. 2 is fixed integrally to a sponge casing 101 by threadedly engaging a threaded portion 93 at a lower end of the shaft pin 83 with the sponge casing 101.

The shaft pin 83 has an outwardly extending plate portion 95. A ring-shaped projection 91 is formed in an upper surface of the plate portion 95 at a position opposite the ring groove 65. Pins 94 are attached to the shaft pin 83 at positions opposite the two engaging holes 69. As a cleaning member, a sponge 105 made of porous material, such as polyvinyl formal (PVF), is provided.

The shaft pin 83 fixed to the sponge casing 101 is attached to the lower surface of the bushing housing 61 while coil springs 81 are accommodated in the spring insertion holes 67. An upper end of the shaft pin 83 which has been inserted into the linear bushing 75 is projected above the upper fixing member 77, and a washer 87 is fixed to the upper end of the shaft pin 83 by using a screw 89. Thus, the shaft pin 83 does not escape vertically downward from the linear bushing 75.

When the sponge 105 needs to be exchanged due to a lowering of a cleaning ability thereof, the casing 1-3 is first removed and the sponge casing 101 and the sponge 105 are then removed from the shaft pin 83 as a unit by releasing the engagement of the threaded portion 93, followed by exchanging the sponge 105 for a new sponge.

The ring-shaped projection 91 of the shaft pin 83 is inserted into the ring groove 65 and the pins 94 are inserted into the engaging holes 69.

Thus, the shaft pin 83 is supported by the linear bushing 75 in a vertically movable state, while being resiliently pressed downward by the coil springs 81. In FIG. 2, for the purpose of explanation, a gap is formed between the washer 87 and the fixing member 77. Actually, however, the washer 87 and the fixing member 77 are in contact in an unloaded state in which the sponge 105 is not pressed against the semiconductor wafer W.

A swing arm 110 (corresponding to the arm 7 shown in FIG. 1) for pivoting and vertically moving the scrubbing apparatus having the pencil type cleaning member is connected to the casings 1-2 and 1-3. A pipe 111 has one end connected to the casing 1-3 and the other end connected to a vacuum pump (not shown).

When the drive motor 50 is driven, the motor shaft 53, the member 57 and the bushing housing 61 rotate as a unit and a rotation force of the bushing housing 61 is transmitted through the pins 94 to the shaft pin 83, to thereby rotate the shaft pin 83, the sponge casing 101 and the sponge 105 as a unit.

While driving the drive motor 50, the vacuum pump connected to the pipe 111 is also driven, to thereby control a pressure in the casing 1 to be a negative pressure relative to an air pressure outside of the casing.

In this state, the sponge 105 is pressed against the semiconductor wafer W which is rotating, and the position on the wafer at which the sponge 105 is pressed is changed, by moving the sponge 105 at least radially from the center of the semiconductor wafer W by means of the arm 110, to thereby clean the entire exposed surface of the semiconductor wafer W.

As mentioned above, the shaft pin 83 is supported in a vertically movable state while being resiliently pressed downward by the coil springs 81. Therefore, when the sponge 105 is pressed against the semiconductor wafer W with a large force, the shaft pin 83 moves upward correspondingly.

Even when permanent deformation or wear of the sponge 105 occurs as a result of prolonged use, the shaft pin 83 moves in a direction of an axis of rotation (vertical direction) correspondingly, so that any change in pressure exerted by the sponge 105 as a result of prolonged use, relative to the pressure exerted by the sponge 105 in an early period, can be minimized.

Further, in the present invention, the linear bushing 75 is provided between the shaft pin 83 fixed relative to the sponge 105 and the bushing housing 61 fixed relative to the drive motor 50, such that the shaft pin 83 is capable of moving in the vertical axial direction with respect to the bushing housing 61, so that the members fixed relative to the sponge 105 can be slidably moved smoothly and accurately in the axial or vertical direction, with respect to the members fixed relative to the drive motor 50. Therefore, a load applied to the semiconductor wafer W by the sponge 105 can be maintained at a predetermined level and the sponge 105 can be adjusted immediately and smoothly following a slight change in load applied to the semiconductor W.

Each of the coil springs 81 in the bushing housing 61 is coated with a synthetic resin, such as fluororesin, making it possible to prevent a metal constituting the coil spring 81 from fusing and contaminating the semiconductor wafer W during cleaning and also prevent corrosion of the coil spring 81 itself.

As mentioned above, in the present invention, the pressure in the casing 1 is maintained at a negative pressure relative to the air pressure outside of the casing. Therefore, although various contaminants are likely to be generated in the casing 1, such contaminants do not leak from the casing 1, and consequently contamination of the semiconductor wafer W during cleaning can be prevented.

In this embodiment of the present invention, the ring-shaped projection 91 is inserted into the ring groove 65. Therefore, the cleaning liquid supplied to the semiconductor wafer W during cleaning, such as purified water or a chemical, does not enter any part of the linear bushing 75, so that corrosion of the linear bushing 75 can be prevented.

Figure 4:
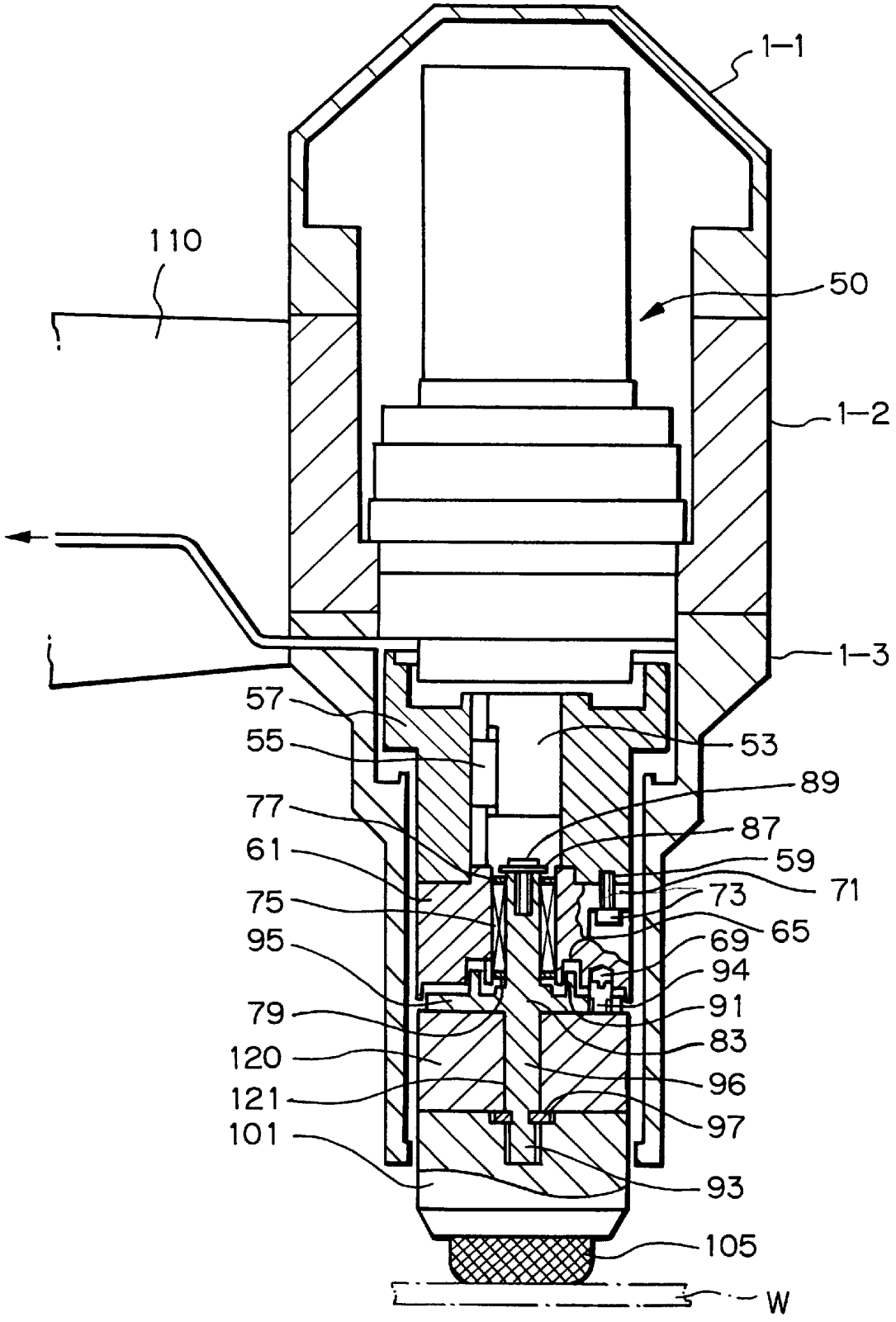
FIG. 4 is a partial longitudinal sectional view of a cleaning member supporting part according to a second embodiment of the present invention.

FIG. 4 is a side cross-sectional view of a scrubbing apparatus having a pencil type cleaning member according to a second embodiment of the present invention. In FIG. 4, the same parts or portions as those in the first embodiment shown in FIG. 2 are designated by the same reference numerals and will not be described in detail.

This scrubbing apparatus is substantially the same as the scrubbing apparatus in the first embodiment shown in FIG. 2, except that the coil springs 81 are not used and a weight 120 in a substantially columnar form is attached to a lower surface of the plate portion 95 of the shaft pin 83.

The weight 120 is fixed by allowing a shaft portion 96 projecting from the center of a lower surface of the shaft pin 83 to pass through a center hole 121 of the weight 120 and attaching a fixing ring 97 to the shaft portion 96. The sponge casing 101 fixed to the sponge 105 is threadedly engaged with the threaded portion 93 provided at a lower end of the shaft portion 96.

The weight 120 is composed of a metal, such as iron or lead, which is resin-coated.

In this embodiment, the shaft pin 83 is in a vertically movable state and the weight 120 always applies a predetermined load downwardly to the shaft pin 83. Therefore, when the scrubbing apparatus as a whole is lowered following engagement of the sponge 105 with the semiconductor wafer W. the shaft pin 83 relatively moves upward, to thereby maintain a load applied to the semiconductor wafer W at a predetermined level.

Thus, as in the case of the first embodiment, even when permanent deformation or wear of the sponge 105 occurs as a result of prolonged use, any change in pressure exerted by the sponge 105 relative to the pressure exerted by the sponge 105 in an early period can be minimized. Since the members fixed relative to the sponge 105 can be linearly moved in a direction of an axis of rotation (vertical direction) accurately and smoothly without resistance, with respect to the members fixed relative to the drive motor 50, the load applied to the semiconductor wafer W by the sponge 105 can be maintained at a predetermined level and the cleaning member can be adjusted immediately and smoothly following a slight change in load applied to the semiconductor wafer W.

Figure 5:
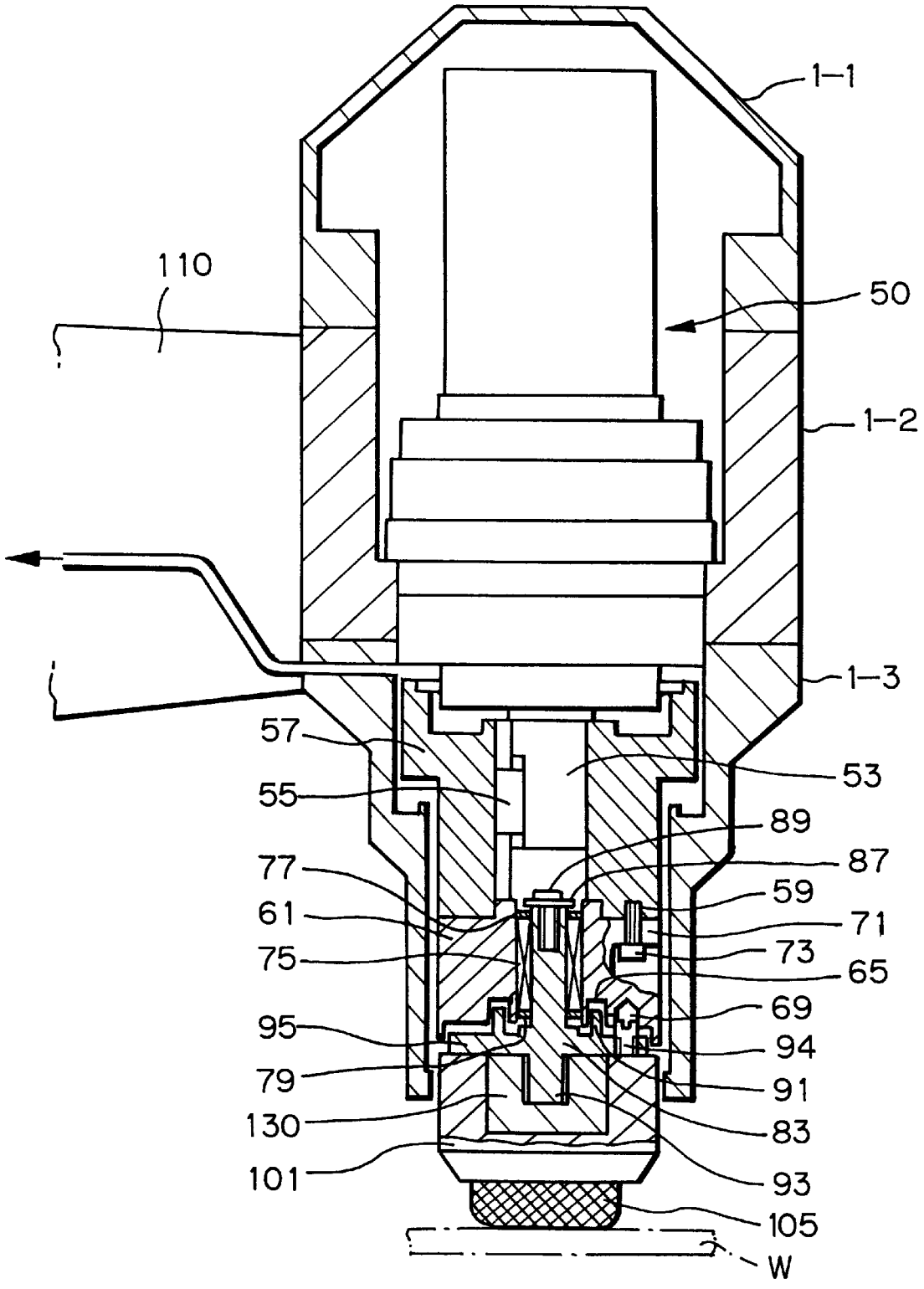
FIG. 5 is a partial longitudinal sectional view of a cleaning member supporting part according to a third embodiment of the present invention.

FIG. 5 is a side cross-sectional view of a scrubbing apparatus having a pencil type cleaning member according to a third embodiment of the present invention. In FIG. 5, the same parts or portions as those in the first embodiment shown in FIG. 1 are designated by the same reference numerals and will not be described in detail.

This scrubbing apparatus is substantially the same as the scrubbing apparatus in the first embodiment shown in FIG. 1, except that the coil springs 81 are not used and, instead, a weight 130 is embedded in the sponge casing 101.

The weight 130 is fixed in the sponge casing 101 and is threadedly engaged with the threaded portion 93 provided in the shaft pin 83. The weight 130 is composed of a metal, such as iron or lead, which is resin-coated.

Instead of providing the weight 130 separately from the sponge casing 101 as in the case of this embodiment, the sponge casing 101 having an appropriate weight may be used so that the semiconductor wafer W is pressed by the weight of the sponge casing 101.

In this embodiment, as in the case of the second embodiment, the load applied to the semiconductor wafer W is maintained at a predetermined level.

Hereinabove, explanation has been made on various examples of the cleaning member supporting part in the cleaning apparatus according to the present invention. However, the present invention is not limited to the above-mentioned embodiments. For example, the present invention can be modified in various forms as mentioned below.

① The workpiece to be cleaned is not limited to semiconductor wafers and may be various workpieces, such as liquid crystal plates.

② As the cleaning member, the sponge is used in the above-mentioned embodiments. However, various materials, such as cloth, polyurethane foam, polyester or a brush, may be used for the cleaning member. In the present invention, because the pressure applied to the workpiece by the cleaning member can be maintained at a predetermined level, a relatively hard material having low elasticity, such as cloth, may be used alone as a material for the cleaning member and the cleaning material made of such material may directly apply a pressure to the workpiece, without a member capable of reducing the pressure, such as a sponge, being provided therebetween.

③ In the above-mentioned embodiments, the drive motor 50 is provided vertically above the sponge 105. However, the drive motor 50 may be provided at a position which is different from that in the above-mentioned embodiments (for example, the other end of the arm 110) so that the driving force of the drive motor 50 is transmitted through a timing belt to the sponge 105. That is, the position of the drive motor 50 is not specifically limited, as long as the driving force of the drive motor 50 can be transmitted to the sponge 105.

Figure 6:
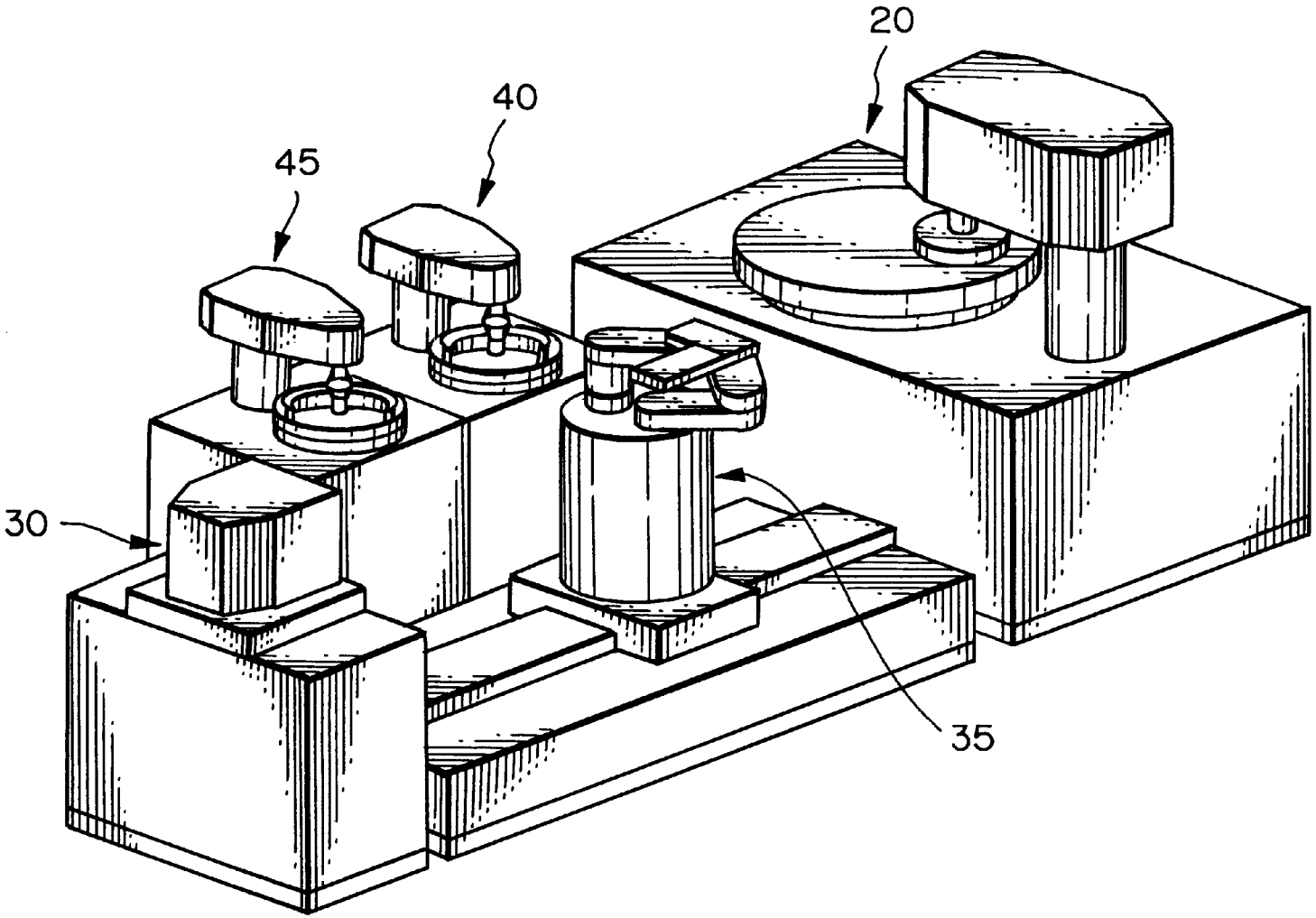
FIG. 6 is a perspective view of a system comprising the cleaning apparatus of the present invention combined with a polishing apparatus.

FIG. 6 is a perspective view of a system comprising the cleaning apparatus of the present invention combined with a polishing apparatus. FIG. 6 shows a polishing apparatus 20, a wafer storage cassette 30, a feed robot 35, a first cleaning apparatus 40 and a second cleaning apparatus 45.

In the manufacture of semiconductors, a polishing process is conducted for polishing a surface of a semiconductor wafer to a flat mirror finish. When it is intended to form two or more wiring layers on the semiconductor wafer, the surface of the wafer on which one layer has been formed is flattened in the polishing process so that another layer can be easily formed thereon.

Figure 7:
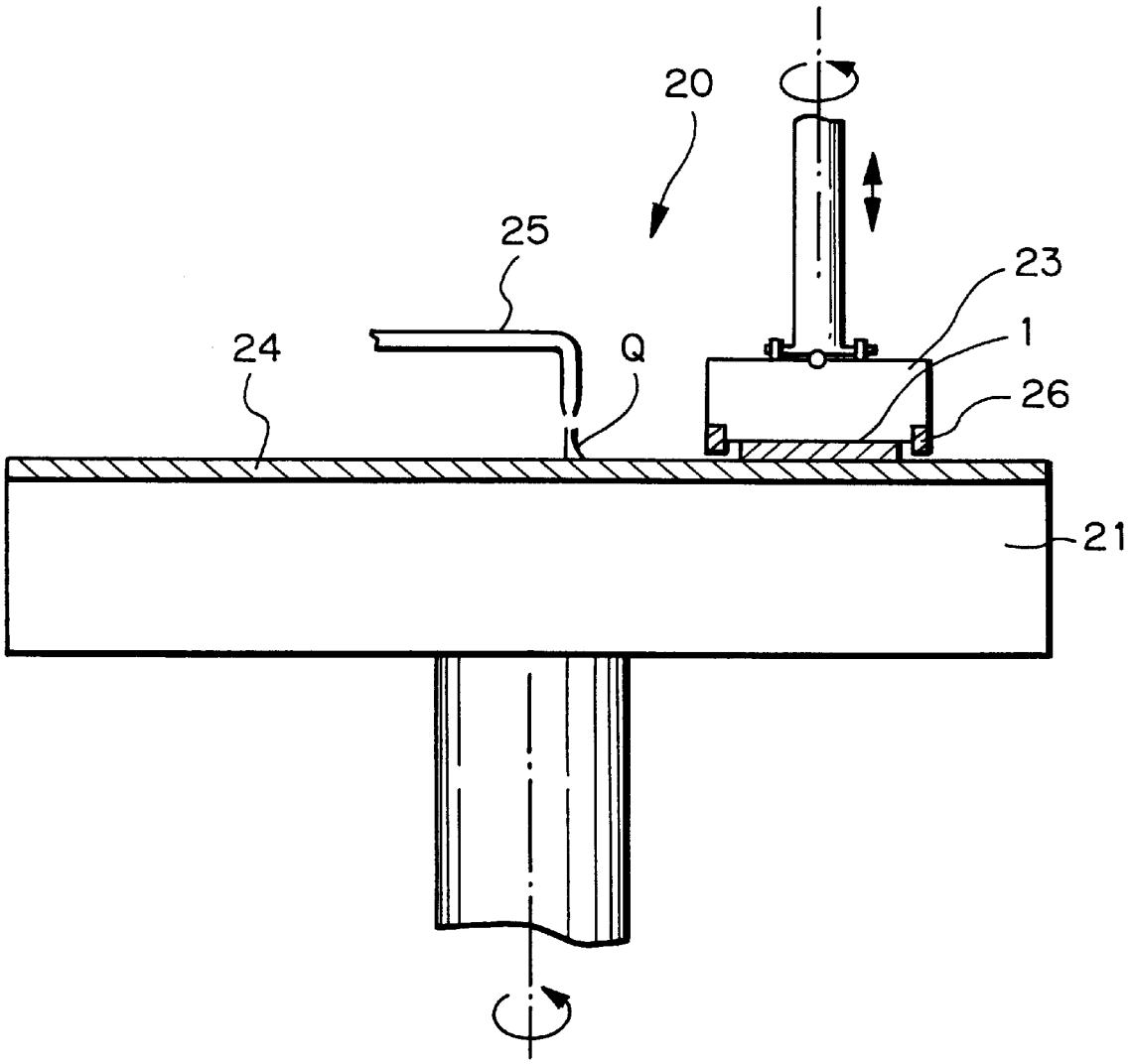
FIG. 7 is a partial longitudinal sectional view of the polishing apparatus in the system shown in FIG. 6.

FIG. 7 is an illustration showing a detail of the polishing apparatus 20 in FIG. 6. As shown in FIG. 7, the polishing apparatus 20 comprises a turntable 21, and a top ring or wafer carrier 23 adapted to hold and press a semiconductor wafer 1 against the turntable 21. The turntable 21 is connected to a motor (not shown) and is capable of rotating on an axis thereof, as indicated by an arrow in FIG. 7. A polishing cloth 24 is adhered to an surface of the turntable 21. The polishing cloth 24 is made of the same material as that of the cleaning member 3 in the cleaning apparatus shown in FIGS. 1 and 2.

The top ring 23 is connected to both a motor (not shown) and a piston-cylinder unit (not shown) for vertically moving the top ring 23. Thus, the top ring 23 is not only capable of vertically moving but also capable of rotating on an axis thereof as indicated by arrows in FIG. 7, and is adapted to press the semiconductor wafer 1 against the polishing cloth 24 under a desired pressure. Further, a polishing abrasive liquid nozzle 25 is provided above the turntable 21. A polishing abrasive liquid Q is supplied from the polishing abrasive liquid nozzle 25 onto the polishing cloth 24 adhered to the turntable 21.

In the polishing apparatus arranged as mentioned above, the semiconductor wafer 1 is held on a lower surface of the top ring 23 and is pressed, by the above-mentioned cylinder, against the polishing cloth 24 on the upper surface of the turntable 21 which is rotating. On the other hand, the polishing abrasive liquid Q streams from the polishing abrasive liquid nozzle 25 onto the polishing cloth 24. Thus, polishing is conducted while the polishing abrasive liquid Q is present between a surface to be polished (lower surface) of the semiconductor wafer 1 and the polishing cloth 24.

The semiconductor wafer after the polishing carries thereon abrasive particles contained in the abrasive liquid and ground-off pieces of the semiconductor wafer. In addition, the abrasive liquid used for polishing is of an alkali base, so that the polished surface of the wafer is inevitably contaminated with an alkaline metal (K: potassium). Therefore, the semiconductor wafer must be cleaned after the polishing.

First, a wafer in the wafer storage cassette 30 is fed to the polishing apparatus 20 by the feed robot 35 and polished. The wafer which has been polished in the polishing apparatus 20 in FIG. 6 is reversed by a reversing mechanism (not shown) so that the polished surface faces upward. Subsequently, the wafer is fed to the first cleaning apparatus 40 by the feed robot 35 and cleaned. In the first cleaning apparatus 40, the wafer is scrubbed by using a brush, to thereby remove a substantial amount of the abrasive liquid remaining on the polished surface of the wafer.

After cleaning in the first cleaning apparatus 40, the wafer is fed to the second cleaning apparatus 45 without surface drying. In the second cleaning apparatus 45, the wafer is scrubbed by using the above-mentioned cleaning member in the cleaning apparatus of the present invention in a manner which has been illustratively described above, to thereby remove particles at a submicron level.

In this example, the cleaning apparatus of the present invention is combined with a polishing apparatus. However, the cleaning apparatus of the present invention may be combined with various apparatuses used in semiconductor production processes, such as an etching apparatus or a CVD apparatus.

In the above-mentioned embodiments, the present invention is applied to the cleaning of a semiconductor wafer. However, needless to say, the present invention is applicable to the cleaning of a substrate which needs to have a high degree of cleanness, such as a glass substrate or a liquid crystal panel. Thus, various modifications are possible without departing from the principle of the present invention.

As has been described above, the present invention exerts advantageous effects as mentioned below.

① The pressure applied to the workpiece by the cleaning member, such as a sponge, does not change even when permanent deformation or wear of the cleaning member occurs as a result of prolonged use.

② Because the cleaning apparatus adopts a resilient member or a weight as means for keeping a constant pressure between the cleaning member of the apparatus and a workpiece to be cleaned, instead of an air cylinder or a balancing weight which are used in prior art cleaning apparatuses, the cleaning apparatus is simple in construction and compact.

③ Because the resilient means or weight is provided between the cleaning member and the drive motor, the resilient means or weight only needs to apply a load to the cleaning member and the members fixed relative to the cleaning member. Therefore, the resilient means or weight can be small and the cleaning member can be adjusted following a slight change thereof, to thereby maintain a load applied to the workpiece by the cleaning member at a predetermine level.

④ A bushing linear bush is provided between the cleaning member and the drive motor so that the cleaning member is capable of slidably moving in a direction of an axis of rotation with respect to the drive motor. Therefore, the members fixed relative to the cleaning member can be linearly moved in a direction of an axis of rotation accurately and smoothly without resistance, with respect to the members fixed relative to the drive motor. Consequently, the load applied to the workpiece by the cleaning member can be maintained at a predetermined level and the cleaning member can be adjusted immediately and smoothly following a slight change in load applied to the workpiece.

⑤ The pressure in the casing is a negative pressure relative to an air pressure outside of the casing. Therefore, although various contaminants are likely to be generated in the casing, such contaminants do not leak from the casing, and consequently contamination of the workpiece during cleaning can be prevented.

What is claimed is:

1. A cleaning apparatus for cleaning a surface of a workpiece, comprising:

a rotatable housing arranged to be operably coupled to a drive shaft of a drive motor to rotate therewith about a rotation axis;

a rotatable shaft pin mounted in said rotatable housing for rotation therewith about said rotation axis, said rotatable shaft pin being axially movably mounted in said rotatable housing for movement relative thereto along said rotation axis;

a cleaning member secured to said rotatable shaft pin for rotation and axial movement therewith; and a pressure applying member physically located between said rotatable housing and said cleaning member to maintain pressure in an axial direction along said rotation axis by said cleaning member against the surface of the workpiece while allowing axial movement of said rotatable shaft pin relative to said rotatable housing;

wherein said rotatable shaft pin includes a radially outwardly projecting flange plate, and said pressure applying member is interposed between said rotatable housing and said flange plate so as to press said flange plate and said cleaning member in said axial direction away from said rotatable housing.

2. A cleaning apparatus according to claim 1, wherein said pressure applying member comprises at least one spring member.

3. A cleaning apparatus according to claim 1, wherein said rotatable housing has at least one spring insertion hole formed therein opening in a direction toward said flange plate of said rotatable shaft pin; and said pressure applying member comprises at least one spring member disposed in said at least one spring insertion hole of said rotatable housing and acting against said flange plate of said rotatable shaft pin.

4. A cleaning apparatus according to claim 1, wherein said rotatable housing has a plurality of spring insertion holes formed therein, opening in a direction toward said flange plate of said rotatable shaft pin and spaced circumferentially around said rotation axis; and said pressure applying member comprises a plurality of spring members disposed in said spring insertion holes, respectively, of said rotatable housing and acting against said flange plate of said rotatable shaft pin.

5. A cleaning apparatus for cleaning a surface of a workpiece, comprising:

a rotatable housing arranged to be operably coupled to a drive shaft of a drive motor to rotate therewith about a rotation axis;

a rotatable shaft pin mounted in said rotatable housing for rotation therewith about said rotation axis, said rotatable shaft pin being axially movably mounted in said rotatable housing for movement relative thereto along said rotation axis;

a cleaning member secured to said rotatable shaft pin for rotation and axial movement therewith; and a pressure applying member physically located between said rotatable housing and said cleaning member to maintain pressure in an axial direction along said rotation axis by said cleaning member against the surface of the workpiece while allowing axial movement of said rotatable shaft pin relative to said rotatable housing;

wherein said pressure applying member is physically located between said rotatable housing and said rotatable shaft pin;

wherein said rotatable housing has a plurality of spring insertion holes formed therein, opening in a direction toward said rotatable shaft pin and spaced circumferentially around said rotation axis; and wherein said pressure applying member comprises a plurality of spring members disposed in said spring insertion holes, respectively, of said rotatable housing and acting against said rotatable shaft pin.

6. A cleaning apparatus for cleaning a surface of a workpiece, comprising:

a rotatable housing arranged to be operably coupled to a drive shaft of a drive motor to rotate therewith about a rotation axis;

a rotatable shaft pin mounted to said rotatable housing for rotation therewith about said rotation axis, said rotatable shaft pin being axially movably mounted to said rotatable housing for movement relative thereto along said rotation axis;

a cleaning member secured to said rotatable shaft pin for rotation and axial movement therewith;

a pressure applying member physically located between said rotatable housing and said cleaning member to maintain pressure in an axial direction along said rotation axis by said cleaning member against the surface of the workpiece while allowing axial movement of said rotatable shaft pin relative to said rotatable housing;

wherein said pressure applying member comprises a weight member fixed for axial movement with said rotatable shaft pin and said cleaning member so as to press said rotatable shaft pin and said cleaning member in said axial direction away from said rotatable housing;

wherein said weight member is concentric with said rotatable shaft pin and said cleaning member; and wherein said rotatable shaft pin includes a radially outwardly projecting flange plate, and said pressure applying member is interposed between said flange plate and said cleaning member so as to press said cleaning member in said axial direction away from said rotatable housing.

7. A cleaning apparatus for cleaning a surface of a workpiece, comprising:

a rotatable housing arranged to be operably coupled to a drive shaft of a drive motor to rotate therewith about a rotation axis;

a rotatable shaft pin mounted to said rotatable housing for rotation therewith about said rotation axis, said rotatable shaft pin being axially movably mounted to said rotatable housing for movement relative thereto along said rotation axis;

a cleaning member secured to said rotatable shaft pin for rotation and axial movement therewith;

a pressure applying member physically located between said rotatable housing and said cleaning member to maintain pressure in an axial direction along said rotation axis by said cleaning member against the surface of the workpiece while allowing axial movement of said rotatable shaft pin relative to said rotatable housing;

wherein said pressure applying member comprises a weight member fixed for axial movement with said rotatable shaft pin and said cleaning member so as to press said rotatable shaft pin and said cleaning member in said axial direction away from said rotatable housing;

wherein said weight member is concentric with said rotatable shaft pin and said cleaning member;

wherein said weight member has a center through hole therein; and wherein said rotatable shaft pin includes a pin portion extending through said center through hole of said weight member.

8. A cleaning apparatus according to claim 7, wherein said pin portion includes a tip end portion protruding from said weight member and secured to said cleaning member.

9. A cleaning apparatus for cleaning a surface of a workpiece, comprising:

a rotatable housing arranged to be operably coupled to a drive shaft of a drive motor to rotate therewith about a rotation axis;

a rotatable shaft pin mounted to said rotatable housing for rotation therewith about said rotation axis, said rotatable shaft pin being axially movably mounted to said rotatable housing for movement relative thereto along said rotation axis;

a cleaning member secured to said rotatable shaft pin for rotation and axial movement therewith;

a pressure applying member physically located between said rotatable housing and said cleaning member to maintain pressure in an axial direction along said rotation axis by said cleaning member against the surface of the workpiece while allowing axial movement of said rotatable shaft pin relative to said rotatable housing;

wherein said pressure applying member comprises a weight member fixed for axial movement with said rotatable shaft pin and said cleaning member so as to press said rotatable shaft pin and said cleaning member in said axial direction away from said rotatable housing;

wherein said weight member is concentric with said rotatable shaft pin and said cleaning member;

wherein said weight member is embedded concentrically in said cleaning member; and wherein said rotatable shaft pin includes a tip end portion secured to said weight member.

* * * * *